US012422231B2

(12) United States Patent
Gizowski

(10) Patent No.: US 12,422,231 B2
(45) Date of Patent: Sep. 23, 2025

(54) SPINNING PROJECTILE

(71) Applicant: Ethics Archery LLC, Vale, NC (US)

(72) Inventor: Frederick Scott Gizowski, Vale, NC (US)

(73) Assignee: Ethics Archery LLC, Vale, NC (US)

( * ) Notice: Subject to any disclaimer, the term of this patent is extended or adjusted under 35 U.S.C. 154(b) by 0 days.

(21) Appl. No.: 18/406,585

(22) Filed: Jan. 8, 2024

(65) Prior Publication Data

US 2024/0183642 A1 Jun. 6, 2024

Related U.S. Application Data

(63) Continuation-in-part of application No. 17/893,566, filed on Aug. 23, 2022, now Pat. No. 11,898,827, which is a continuation of application No. 15/984,791, filed on May 21, 2018, now Pat. No. 11,421,970.

(60) Provisional application No. 62/603,244, filed on May 22, 2017.

(51) Int. Cl.

| | |
|---|---|
| ***F42B 10/28*** | (2006.01) |
| ***F42B 10/26*** | (2006.01) |
| ***F42B 12/02*** | (2006.01) |
| ***F42B 30/02*** | (2006.01) |

(52) U.S. Cl.

CPC ..... *F42B 10/28* (2013.01); *F42B 10/26* (2013.01); *F42B 12/02* (2013.01); *F42B 30/02* (2013.01)

(58) Field of Classification Search

CPC ..... F42B 10/00; F42B 10/26; F42B 10/28; F42B 10/38; F42B 12/00; F42B 12/02; F42B 14/00; F42B 14/02; F42B 30/02

USPC ..... 102/439, 501, 516, 517, 524, 526, 525, 102/527, 528; 244/3.23; 42/51; 89/1.3

See application file for complete search history.

(56) References Cited

U.S. PATENT DOCUMENTS

| | | | | |
|---|---|---|---|---|
| 114,807 | A | 5/1871 | Hancock | |
| 336,556 | A | 2/1886 | Douglas | |
| 486,657 | A | 11/1892 | Ashley | |
| 1,442,080 | A | 1/1923 | Tadaus | |
| 3,388,696 | A | 6/1968 | Hoverath | |
| 3,861,311 | A * | 1/1975 | Bilsbury | F42B 12/44 102/515 |
| 3,910,579 | A | 10/1975 | Sprandel | |
| 3,949,677 | A | 4/1976 | Voss | |

(Continued)

OTHER PUBLICATIONS

U.S. Appl. No. 62/603,244 titled Spinning Point Bullet, dated May 22, 2017.

(Continued)

*Primary Examiner* — Joshua E Rodden

(74) *Attorney, Agent, or Firm* — Dinsmore & Shohl LLP

(57) ABSTRACT

A projectile, includes a head having a forward tip and a rear end, a stem extending from the rear end of the head and formed integrally with the head, and a sleeve positioned adjacent to the head and being collinear with the head and coaxial with the stem. The sleeve is hollow and substantially cylindrical and has an inner diameter and an outer diameter. A base is formed integrally with the stem by pressing a rearward end of the stem and expanding a rear dimension of the stem to capture the sleeve between the base and the head. The head and the base are rotatably dependent upon each other by connection with the stem, and the head, stem, and base are rotationally independent of the sleeve.

19 Claims, 9 Drawing Sheets

(56) References Cited

U.S. PATENT DOCUMENTS

| | | | | |
|---|---|---|---|---|
| 4,008,667 | A | 2/1977 | Look | |
| 4,016,817 | A | 4/1977 | Arciniega | |
| 4,024,008 | A | 5/1977 | Gregornik | |
| 4,175,749 | A | 11/1979 | Simo | |
| 4,534,568 | A | 8/1985 | Tone | |
| 4,682,546 | A | 7/1987 | Chovich | |
| 4,943,067 | A | 7/1990 | Saunders | |
| 5,257,809 | A | 11/1993 | Carrizosa | |
| 5,269,534 | A | 12/1993 | Saunders | |
| 5,388,524 | A | 2/1995 | Strandli | |
| 5,609,147 | A | 3/1997 | Wilthorn, Jr. | |
| 5,932,836 | A | 8/1999 | White | |
| 5,971,875 | A | 10/1999 | Hill | |
| 6,305,293 | B1 | 10/2001 | Fry | |
| 6,343,553 | B1 | 2/2002 | O'Dwyer | |
| 6,478,700 | B2 | 11/2002 | Hartman | |
| 6,595,880 | B2 | 7/2003 | Becker | |
| 6,623,385 | B1 | 9/2003 | Cole | |
| 6,776,101 | B1 | 8/2004 | Pickard | |
| 6,817,299 | B1 | 11/2004 | Cooke | |
| 6,997,110 | B2 | 2/2006 | Rastegar | |
| 7,207,908 | B1 | 4/2007 | Gizowski | |
| 7,360,491 | B2 | 4/2008 | Sanborn | |
| 7,900,561 | B2 | 3/2011 | Marx | |
| 8,171,852 | B1 | 5/2012 | Rebar | |
| 8,286,558 | B2 | 10/2012 | Marx | |
| 8,438,767 | B2 * | 5/2013 | Rebar | F42B 12/34 89/1.3 |
| 9,377,277 | B1 * | 6/2016 | Worrell, Jr. | F42B 5/188 |
| 9,410,773 | B2 | 8/2016 | Greenwood | |
| 9,593,921 | B1 | 3/2017 | Kostka | |
| 9,644,929 | B1 | 5/2017 | Bradbury | |
| 9,658,036 | B2 | 5/2017 | Zobell | |
| 11,421,970 | B2 | 8/2022 | Gizowski | |
| 2006/0027128 | A1 | 2/2006 | Hober | |
| 2011/0155014 | A1 | 6/2011 | Marx | |
| 2011/0155016 | A1 | 6/2011 | Marx | |
| 2012/0090492 | A1 * | 4/2012 | Rebar | F42B 12/34 102/517 |
| 2016/0161232 | A1 * | 6/2016 | Rubin | F42B 12/46 102/517 |
| 2018/0216922 | A1 | 8/2018 | Bucher | |
| 2018/0306563 | A1 | 10/2018 | Lotan | |
| 2018/0335285 | A1 * | 11/2018 | Gizowski | F42B 30/02 |
| 2019/0265007 | A1 | 8/2019 | Gizowski | |
| 2023/0384070 | A1 * | 11/2023 | Hall | F42B 14/067 |

OTHER PUBLICATIONS

U.S. Appl. No. 17/893,566, filed Aug. 23, 2022 titled Spinning Projectile.

* cited by examiner

SPINNING PROJECTILE

TECHNICAL FIELD

The present invention relates to the field of shooting using projectile weapons. More particularly, the present invention relates to projectile fired from a weapon which comprises a point and a base which are disposed within a sleeve such that the point and base of the projectile rotate independently of the sleeve when fired from a gun or similar weapon designed to discharge projectiles or similar material.

BACKGROUND OF THE INVENTION

A gun is a normally tubular weapon or other device designed to discharge projectiles or other material. The projectile may be solid, liquid, gas or energy and may be free, as with bullets and artillery shells, or captive as with Taser probes and whaling harpoons. The means of projection varies according to design but is usually affected by the action of gas pressure, either produced through the rapid combustion of a propellant or compressed and stored by mechanical means, operating on the projectile inside an open-ended tube in the fashion of a piston. The confined gas accelerates the movable projectile down the length of the tube, imparting sufficient velocity to sustain the projectile's travel once the action of the gas ceases at the end of the tube or muzzle. Alternatively, acceleration via electromagnetic field generation may be employed in which case the tube may be dispensed with and a guide rail substituted.

Most guns use compressed gas confined by the barrel to propel the bullet up to high speed, though devices operating in other ways are sometimes called guns. In firearms the high-pressure gas is generated by combustion, usually of gunpowder. This principle is similar to that of internal combustion engines, except the bullet leaves the barrel, while the piston transfers its motion to other parts and returns down the cylinder. As in an internal combustion engine, the combustion propagates by deflagration rather than by detonation, and the optimal gunpowder, like the optimal motor fuel, is resistant to detonation. This is because much of the energy generated in detonation is in the form of a shock wave, which can propagate from the gas to the solid structure and heat or damage the structure, rather than staying as heat to propel the piston or bullet. The shock wave at such high temperature and pressure is much faster than that of any bullet and would leave the gun as sound either through the barrel or the bullet itself rather than contributing to the bullet's velocity.

Typical guns or similar weaponry comprise a gun barrel. Barrel types can be rifled or smoothbore. Rifled gun barrels have a series of spiraled grooves or angles within the barrel, which results in an induced spin to stabilize the projectile. Smoothbore barrels lack such grooves and are used when the projectile is stabilized by other means or when rifling is undesired or unnecessary. Typically, interior barrel diameter and the associated projectile size is a means to identify gun variations. Bore diameter is reported in several ways. The more conventional measure is reporting the interior diameter (bore) of the barrel in decimal fractions of the inch or in millimeters. Some guns—such as shotguns—report the weapon's gauge, which is the number of shot pellets having the same diameter as the bore produced from one English pound (454 g) of lead) or—as in some British ordnance—the weight of the weapon's usual projectile.

A gun projectile may be a simple, single-piece item like a bullet, a casing containing a payload like a shotshell or explosive shell, or complex projectile like a sub-caliber projectile and sabot. The propellant may be air, an explosive solid, or an explosive liquid. Some variations like the Gyroject and certain other types combine the projectile and propellant into a single item.

For the present invention, the term gun may refer to any sort of projectile weapon from large cannons to small firearms, which include those that are usually hand-held, known as handguns. The use of the term cannon is interchangeable with gun. Autocannons are automatic guns designed primarily to fire shells and are mounted on a vehicle or other mount. Machine guns are similar, but usually designed to fire simple projectiles. The term gun can also comprise military and naval guns which include any large-caliber, direct-fire, high-velocity, flat-trajectory artillery piece employing an explosive-filled hollowed metal shell or a solid bolt as its primary projectile.

Bullets are made of a variety of materials. They are available singly as they would be used in muzzle loading and cap and ball firearms, as part of a paper cartridge, and much more commonly as a component of metallic cartridges. Bullets are made in a large number of styles and constructions depending on how they will be used. Many bullets have specialized functions, such as hunting, target shooting, training, defense, and warfare. A bullet is not a cartridge. In paper and metallic cartridges, a bullet is one component of the cartridge. Bullet sizes are expressed by their weight and diameter in both English and Metric measurement systems. For example: .22 caliber 55 grain bullets or 5.56 mm 55 grain bullets are the same caliber and weight bullet. The bullets used in many cartridges are fired at a muzzle velocity faster than the speed of sound, which is about 343 m/s or 1126 ft/s in dry air at 20° C. or 68° F. This means they are supersonic and thus can travel a substantial distance and even hit a target before a nearby observer hears the shot. Bullet speed through air depends on a number of factors such as barometric pressure, humidity, air temperature, and wind speed.

Bullets are designed to solve two primary problems. In the barrel, they must first form a seal with the gun's bore. If a strong seal is not achieved, gas from the propellant charge leaks past the bullet, thus reducing efficiency and possibly accuracy. The bullet must also engage the rifling without damaging or excessively fouling the gun's bore, and without distorting the bullet, which will also reduce accuracy. Bullets must have a surface that forms this seal without excessive friction. These interactions between bullet and bore are termed internal ballistics. Bullets must be produced to a high standard, as surface imperfections can affect firing accuracy.

The physics affecting the bullet once it leaves the barrel is termed external ballistics. The primary factors affecting the aerodynamics of a bullet in flight are the bullet's shape and the rotation imparted by the rifling of the gun barrel. Rotational forces stabilize the bullet gyroscopically as well as aerodynamically. Any asymmetry in the bullet is largely canceled as it spins. However, a spin rate greater than the optimum value adds more trouble than good, by magnifying the smaller asymmetries or sometimes resulting in the bullet exploding midway in flight.

Generally, bullet shapes and design are a compromise between aerodynamics, interior ballistic necessities, and terminal ballistics requirements. When a bullet contacts its target, the outcome of the impact is determined by the composition and density of the target material, the angle of incidence, and the velocity and physical characteristics of the bullet itself. Bullets are generally designed to penetrate, deform, or break apart. For a given material and bullet, the strike velocity is the primary factor that determines which outcome is achieved.

Bullets can be made of many materials, as the present invention is directed to bullets made from any material known to be used by those skilled in the art to be used to make bullets. Bullets for black powder, or muzzle-loading firearms, were classically molded from pure lead. These work well for low-speed bullets, fired at velocities of less than 450 m/s (1475 ft/s). For slightly higher-speed bullets fired in modern firearms, a harder alloy of lead and tin or similar metals works very well. For even higher-speed bullet use, jacketed coated lead bullets are used. The common element in all of these, lead, is widely used because it is very dense, thereby providing a high amount of mass—and thus, kinetic energy—for a given volume. Lead is also cheap, easy to obtain, easy to work, and melts at a low temperature, which results in comparatively easy fabrication of bullets. Bullets may also incorporate other metals, such as zinc, tin, antimony, and copper, among others. Bullets intended for higher velocities may be made with jacketed lead, which generally means having a lead core that is jacketed or plated with another metal or metal alloy, such as gilding metal, cupronickel, copper alloys, or steel. The thin layer of harder metal protects the softer lead core when the bullet is passing through the barrel and during flight, which allows delivering the bullet intact to the target. There, the heavy lead core delivers its kinetic energy to the target. A full metal jacket or "ball" bullet is completely encased in the harder metal jacket, except for the base. Some bullet jackets do not extend to the front of the bullet, to aid expansion and increase lethality. These are called soft point if the exposed lead tip is solid, or hollow point if a cavity or hole is present. Steel bullets are often plated with copper or other metals for corrosion resistance during long periods of storage. Synthetic jacket materials such as nylon and Teflon are also known in the arts and are used with some success in rifles. Hollow point bullets with plastic aerodynamic tips have been very successful at both improving accuracy and enhancing expansion.

Other bullets are known in the arts and may be encompassed by the present invention. These include:

(1) Blanks, which are wax, paper, plastic, and other materials used to simulate live gunfire and intended only to hold the powder in a blank cartridge and to produce noise, flame and smoke;

(2) Practice bullets, which are made from lightweight materials like rubber, wax, wood, plastic, or lightweight metal, and which are intended for short-range target work only;

(3) Polymer bullets, which are metal-polymer composites, generally lighter and higher velocity than a pure metal bullet of the same dimensions. They permit unusual designs that are difficult with conventional casting or lathing;

(4) Less lethal bullets which may include rubber, plastic, or beanbag bullets;

(5) Incendiary bullets which are made with an explosive or flammable mixture in the tip that is designed to ignite on contact with a target. The intent is to ignite fuel or munitions in the target area, thereby adding to the destructive power of the bullet itself;

(6) Exploding bullets, which are similar to the incendiary bullet, being designed to explode upon hitting a hard surface, preferably the bone of the intended target;

(7) Tracer bullets, which have a hollow back, filled with a flare material, usually a mixture of magnesium metal, a perchlorate, and strontium salts to yield a bright red color. Tracer material burns out after a certain amount of time and is useful to the shooter as a means of learning how to point and shoot at moving targets with rifles. This type of round is also used by all branches of the United States military in combat environments as a signaling device to friendly forces;

(8) Armor-piercing bullets, which are jacketed designs where the core material is a very hard, high-density metal such as tungsten, tungsten carbide, depleted uranium, or steel. A pointed tip is often used, but a flat tip on the penetrator portion is generally more effective;

(9) Nontoxic shot bullets, which comprise nontoxic shot. These bullets are often steel, bismuth, tungsten, or similar alloys which prevent the release of toxic lead into the environment. Regulations in several countries mandate the use of nontoxic projectiles especially when hunting waterfowl;

(10) Blended metal bullets, which are made using cores from powdered metals other than lead with binder;

(11) Frangible bullets, which are designed to disintegrate into tiny particles upon impact to minimize their penetration for reasons of range safety, to limit environmental impact, or to limit the shoot-through danger behind the intended target, and

(12) Multiple point bullets, which are bullets that are made of separate slugs that fit together inside the cartridge, and act as a single projectile inside the barrel as they are fired. The projectiles part in flight but are held in formation by tethers that keep the individual parts of the "bullet" from flying too far away from each other. The intention of such ammo is to increase hit chance by giving a shot like spread to rifled slug firing guns, while maintaining a consistency in shot groupings.

Long range shooters are aware of the effects of gravity, air resistance (drag), and wind on bullet trajectory. There are commercial ballistics programs that can fairly effectively predict trajectories by accounting for the effects of gravity, wind, and drag. However, there are other effects that effect trajectory, including the gyroscopic drift and Coriolis Effect.

Gyroscopic drift is the effect of the spin of the projectile. A spinning bullet has a "spin axis" about which it spins. Applying force to the spin axis disturbs the spin, causing the spinning object—the bullet or projectile in this case—to react in a strange way. For a bullet fired at an angle on a long-range trajectory, the bullet starts out with a spin axis aligned with its velocity vector. As the trajectory progresses, gravity accelerates the bullet down, toward the ground. The bullet reacts like a spiraling football by falling into a nose-down torque, but surprisingly with a slight rightward point to follow the initial velocity vector. This slight nose-right flight results in some lateral drift known as gyroscopic drift. Bullets fired from a right twist barrel drift to the right. Bullets fired from a left twist barrel drift to the left. Typical gyroscopic draft for small arms trajectories are about 8-9 inches per 1000 yards. Gyroscopic drift is caused by the interaction of the bullet's mass and aerodynamics with the atmosphere in which it is flying. It depends on the atmospheric properties, not the earth's rotation.

Coriolis Effect, or Coriolis Acceleration, is caused by the fact that the Earth is spinning and is actually dependent on where the shooter is on the planet, and which direction he is shooting. It has horizontal and vertical components. The horizontal component depends on the latitude, i.e., the distance north or south from the equator. Maximum horizontal effect is at the poles, and there is no horizontal effect at the equator. Typically, horizontal Coriolis drift for a small arms trajectory fired near 45 degrees North Latitude is about 2.5-3.0 inches to the right at about 1000 yards. The vertical component of the Coriolis Effect depends on the direction the shooter is firing. Firing due North or South results in zero vertical effect. Firing East causes the trajectory to deflect to result in hitting high. Firing West causes the trajectory to deflect to result in hitting low. The vertical component is maximal at the equator and is zero at the poles. Typically, vertical Coriolis deflection at 45 degrees latitude for a 1000-yard trajectory is about 2.5-3.0 inches high or low, depending on the direction.

All of these effects—gravity, air resistance (drag), wind, gyroscopic drift, and Coriolis Effect—can be affected by controlling the spin of the projectile. There is a need for an improved bullet. The flight of prior art bullets is affected by wind resistance acting against them, making it more difficult to effectively hit a target. It is desirable to design a point that does not lose excessive energy due to wind resistance and these other factors, or due to impact with obstructions after hitting a target.

The problem to be corrected is based upon the need for better accuracy in a projectile's trajectory. As currently provided, bullet accuracy is improved on solid projectiles by the internal rifling of the bore. Current solid projectiles must impart spin on the entire mass of the bullet. This adds friction and limits the range of the bullet. The weight limits the battlefield warrior or hunter to the amount of carried ammunition. A spin projectile may be lighter after design refinements as a result of decreased powder charges. Current projectiles have surface contact with the rifling of the barrel along most of the length of the projectile. Reducing the contact surface area to just a portion of the length of the projectile—such as the length of a sleeve on a portion of the projectile—will result in lower friction from the bore rifling. If just such a sleeve is rotated by the rifling, then the sleeve may spin faster than a normal solid projectile. If that sleeve spins faster, it may impart improved ballistic performance or may flatten out the ballistic curve of the projectile.

Moreover, friction from the length of the projectile and powder charges limits sustained firing rates due to the increased generation of heat. By reducing the surface area of to a sleeve portion that is in contact with the bore rifling, there will be a reduction of the heat of the barrel, resulting in a longer sustained firing rate, or improved lifetime of the barrel.

The following patents disclose various improvements in the design of projectiles to improve spin, stability, and accuracy:

U.S. Pat. No. 3,388,696 to Hoverath discloses a magazine and blowpipe for projecting elongate projectiles and which includes a tubular pipe, a magazine, and a plurality of projectiles stored in the magazine and ejected one at a time from a discharge end of the pipe;

U.S. Pat. No. 3,910,579 to Sprandel discloses a swivel action adaptor for securing an arrowhead to the front end of an arrow shaft that includes a bushing that is cemented to the forward end of the arrow shaft and a spindle mounted to the bushing and having a tapered end that is cemented in the socket of the arrowhead;

U.S. Pat. No. 4,175,749 to Simo discloses an arrowhead body for attachment between the nosepiece and the head end of the arrow shaft, and which includes an adaptor having a having a rearward adapter shaft for insertion into the arrow shaft and an opposite forwardly extending adaptor shaft for attachment to the arrowhead body with the adaptor shafts and the adaptor in axial alignment with the arrow shaft and the arrowhead body;

U.S. Pat. No. 4,534,568 to Tone discloses a low frictional rotational element for interconnecting a broad blade arrowhead to the leading end of an arrow shaft, and which includes a housing for permanent installation to the leading end of the arrow shaft and an insert for disposition within the housing, with the insert including annular ridges that serve as low friction bearing surfaces against the inner annular surface of the housing. The insert includes a threaded hole to receive the threaded stud of the arrowhead;

U.S. Pat. No. 4,943,067 to Saunders discloses an arrow insert for a hollow arrow shaft that includes annular alignment rings, an enlarged shoulder, and a glue trap for gluing the insert to the inside annular surface of the arrow so that a field point can be secured to the insert and in position at the front end opening of the shaft of the arrow;

U.S. Pat. No. 5,609,147 to Withorn discloses an arrow thread tracking apparatus for a bow that includes a bolt assembly secured to the bow and a thread attached to the bolt assembly and the arrow for tracking the arrow;

U.S. Pat. No. 5,971,875 to Hill discloses a vaneless arrow shaft that includes a spinner tube having spiral grooves that is placed within the arrow shaft adjacent the nock end, and the arrow shaft having dimples that engage the grooves so that rotation is imparted to the arrow shaft when the bowstring is released for launching the arrow shaft;

U.S. Pat. No. 6,478,700 B2 to Hartman discloses an arrow spin device that includes a screw shaft having cylindrical leading and tailing ends and which is inserted into the arrow shaft so that engagement by, and release from, the bowstring imparts a spin to the arrow without the need for fletching;

U.S. Pat. No. 6,595,880 B2 to Becker discloses a fluted arrow that can be lighter and stronger than standard arrows, and a fluted arrow that has grooves or spirals along its length to impart rotation to the arrow for increased stability and greater velocity;

U.S. Pat. No. 7,207,908 discloses an insert for allowing free rotation of a cutting tip on an arrow shaft, but does not teach or suggest the presently claimed spinning point;

U.S. Pat. No. 3,949,677 to Voss discloses a small caliber projectile with an asymmetrical point which affects the rotation by locating the center of gravity along the projectile's axis of rotation;

U.S. Pat. No. 6,776,101 to Pickard disclose a controlled fragmenting bullet to provide for better distribution of the bullet fragments through an animal's body;

U.S. Pat. No. 4,008,667 to Look discloses a controlled range bullet encompassing a rotary aerodynamic brake that degrades the bullet's lethality after the bullet's trajectory passes a specified distance; and U.S. Pat. No. 6,997,110 to Rastegar discloses a bullet with deployable blades or other portions that deploys prior to impact with a target to increase the footprint of the bullet or decrease the lethality of the bullet for impact with the target.

Nonetheless, despite the ingenuity of the above devices, there remains a need for an improved projectile of all types discussed herein. Differences in the aerodynamics of points and other projectiles renders much of the prior art inapplicable. There is a need for a spinning projectile that allows the tip to freely rotate relative to the body of the projectile, with the spin imparted by the rifling in the barrel of the gun limited to a sleeve around the tip. This will allow more lift and less wind resistance during the flight of the projectile to the target.

BRIEF SUMMARY OF THE INVENTION

It is an object of the present invention to provide a spinning projectile fired from a weapon which comprises a point and a base which are disposed within a sleeve such that the point and base of the projectile rotate independently of the sleeve when fired from a gun or similar weapon designed to discharge projectiles or similar material.

SUMMARY OF THE INVENTION

The present invention comprehends a spinning projectile fired from a weapon which comprises a point and a base which are disposed within a sleeve such that the point and base of the projectile rotate independently of the sleeve when fired from a gun or similar weapon designed to discharge projectiles or similar material. The sleeve spin is imparted by the rifling in the spinning point results in better accuracy, better projectile speed, and better target penetration.

In archery, a spin point for arrows allows the point to spin around a central axis of the arrow. Because the point can spin, it allows the fletching of the arrow not to have to spin the entire mass of the point, allowing the fletched arrow shaft to spin faster around the non-spinning point, resulting in increased arrow accuracy. While the differences between archery and the shooting sports are substantial, rendering such prior art based on archery largely irrelevant, the inventor has found that a spinning projectile design assembly results in improved projectile characteristics, including a flattened trajectory and increased accuracy with a projectile. This limits the spin to a sleeve part of the assembly. Rather than having the internal rifling of the bore spin the entire mass of a projectile, a spin projectile limits the mass of the spin to a fraction of the mass because only the sleeve is subject to the spin imparted by the rifling in the barrel. The spin imparted to the sleeve part may result in the sleeve spinning faster than the entire mass of the projectile. This is believed to improve the ballistic properties of the projectile or flatten the projectile trajectory. This design is scalable from small pistol and rifle projectiles to multi-centimeter, large-bore delivered projectiles.

In an embodiment of the present invention, the spinning projectile is a mechanical assembly of a Projectile Head 1, a Sleeve 2 and a Base 3, as seen in FIGS. 1-4. The interaction of the spinning projectile with the rifling of the gun barrel is limited to the sleeve portion. Accordingly, the mass of the projectile subject to the spin is limited, allowing the Projectile Head and Base to not spin. It is believed that such a reduction in the mass of the projectile subject to spinning will likely result in an increased projectile, velocity and/or a flattening of the projectile trajectory.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

REFERENCE NUMERALS IN THE DRAWINGS

Figure 1:
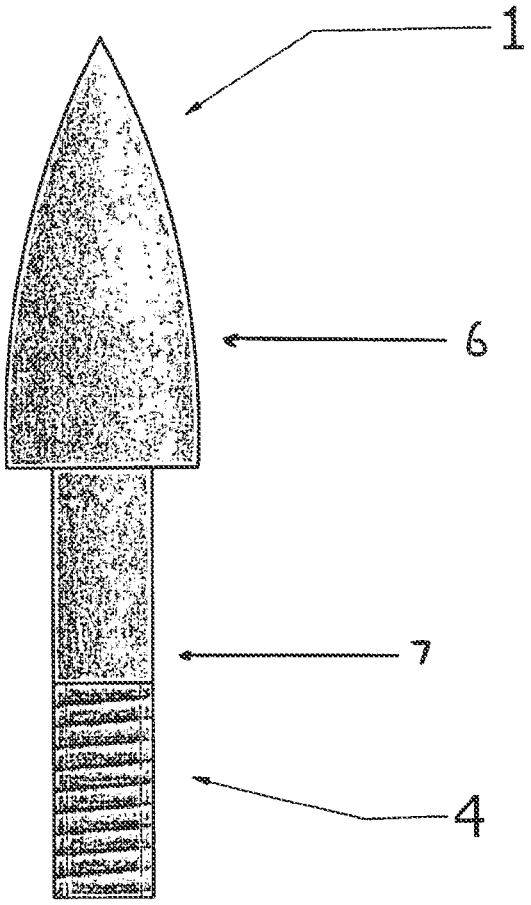
FIG. 1 is a drawing of the head component of the present invention, according to one or more embodiments shown and described herein.

1. Head
2. Sleeve component
3. Base component
4. External Threads
5. Internal Threads
6. Point
7. Stem component
9. Separations
10. Alignment mechanism
12. Sleeve component outer diameter
14. Sleeve component inner diameter
16. Stem component outer diameter
18. Base component outer diameter

DETAILED DESCRIPTION

Various embodiments of the invention are described more fully hereinafter with reference to the accompanying drawings. Some, but not all, embodiments of the invention are shown in the figures. Indeed, the disclosed invention may be embodied in many different forms and should not be construed as limited to the embodiments set forth herein. Rather, these embodiments are provided as examples, and so that this disclosure will satisfy legal requirements.

Figure 2:
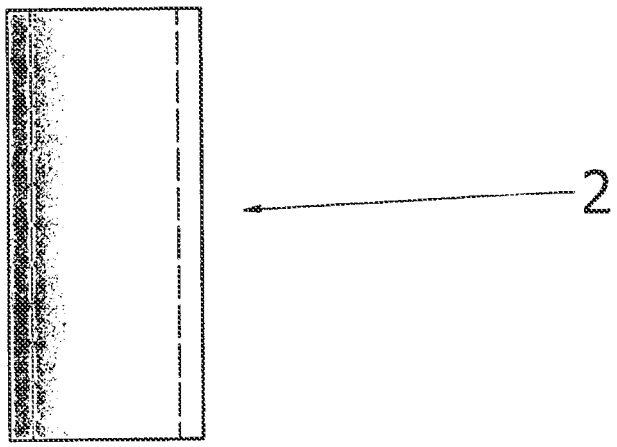
FIG. 2 is a drawing of the sleeve component of the present invention, according to one or more embodiments shown and described herein.
Figure 3:
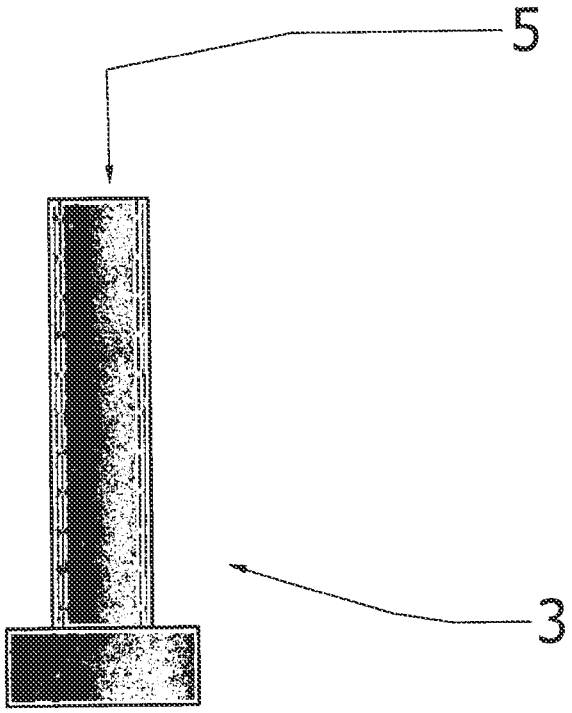
FIG. 3 is a drawing of the base component of the present invention, according to one or more embodiments shown and described herein.

FIGS. 1-3 show the parts and assembly for an example of a 9 mm projectile. It is understood that the same principles can be applied to substantially any size projectile fired by a gun or similar device.

FIG. 1 shows the head 1 of the spinning projectile of the present invention.

FIG. 2 shows the sleeve component 2 of the present invention.

FIG. 3 shows the base component 3 of the present invention.

Figure 4:
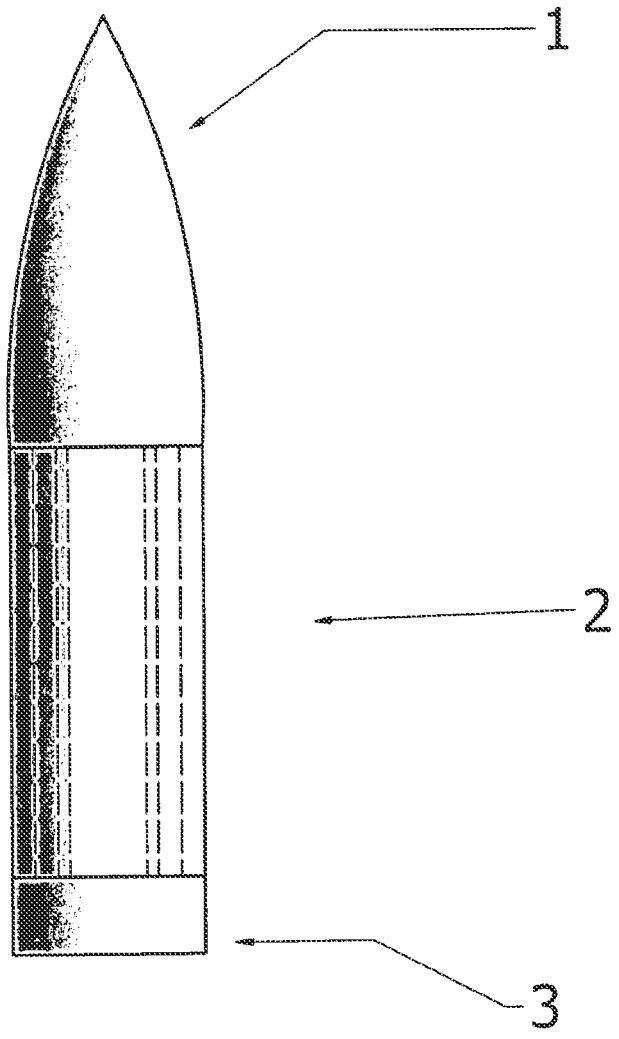
FIG. 4 is a drawing of the assembled projectile of the present invention; according to one or more embodiments shown and described herein.

FIG. 4 shows a drawing of the prototype spin projectile design. The diameter of the Head 1 and the Base 3 are slightly smaller than the Sleeve 2 diameter such that the bore rifling is only in contact with the Sleeve diameter.

With the present innovative improvement, the spinning projectile should provide the following benefits as compared to a solid projectile in which the entire projectile is subject to spinning:

(1) Flatter trajectory, increased accuracy
(2) Reduced bore friction
(3) Higher sustained rate of fire
(4) Reduced powder charge
(5) Quieter firing for silencers
(6) Extended range of projectile
(7) Increased standoff distance
(8) Scalable design In a preferred embodiment of the present invention, the projectile head 1 and the base 3 are machined to a slightly smaller diameter than the sleeve 2. The sleeve 2 is the only portion of the projectile that engages the bore's inner rifling. The projectile head 1 and base 3 do not engage the rifling and therefore do not spin with the sleeve. As a non-limiting example, powdered graphite or other lubricants may assist with reducing friction within the assembly. The disclosed spin relationship may increase velocity, reduce internal bore friction, or may flatten the projectile ballistic curve.

In a further preferred embodiment, the head 1 of the spinning projectile of the present invention is manufactured with a substantially pointed portion 6 and a stem 7. In a further preferred embodiment, the stem can comprise external threads 4. The sleeve component 2 is sized to have a diameter slightly larger than the head 1, and the sleeve is placed over the stem of the head 1 to form the projectile of the present invention. The base component 3 comprises internal threads 5 which engage the external threads of the stem of the head portion of the present invention to form the projectile of the present invention. The Head 1 and the Base 3 are slightly smaller than the Sleeve 2 diameter such that the bore rifling is only in contact with the Sleeve diameter.

The projectile design is scalable from a 5.56 caliber, 9 mm bullet, to multi-centimeter diameter projectiles that are bore delivered, such as naval guns, tank rounds, and artillery.

Figure 5B:
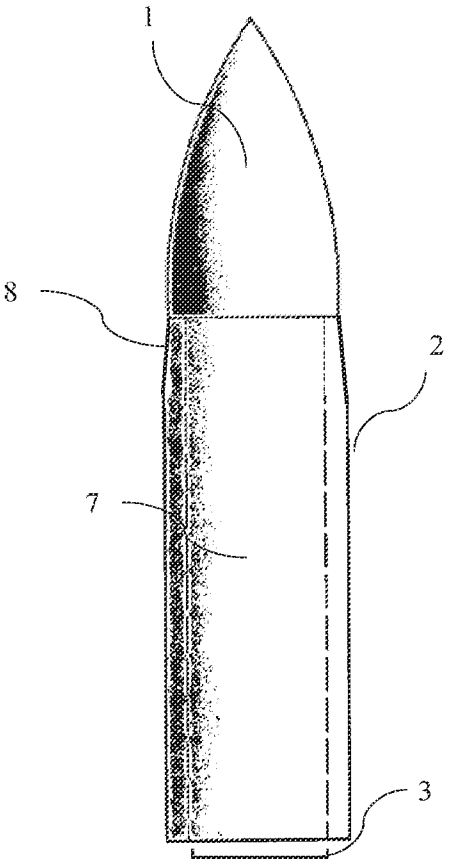
FIG. 5B is an assembled view of the projectile of FIG. 5A, according to one or more embodiments shown and described herein.
Figure 5A:
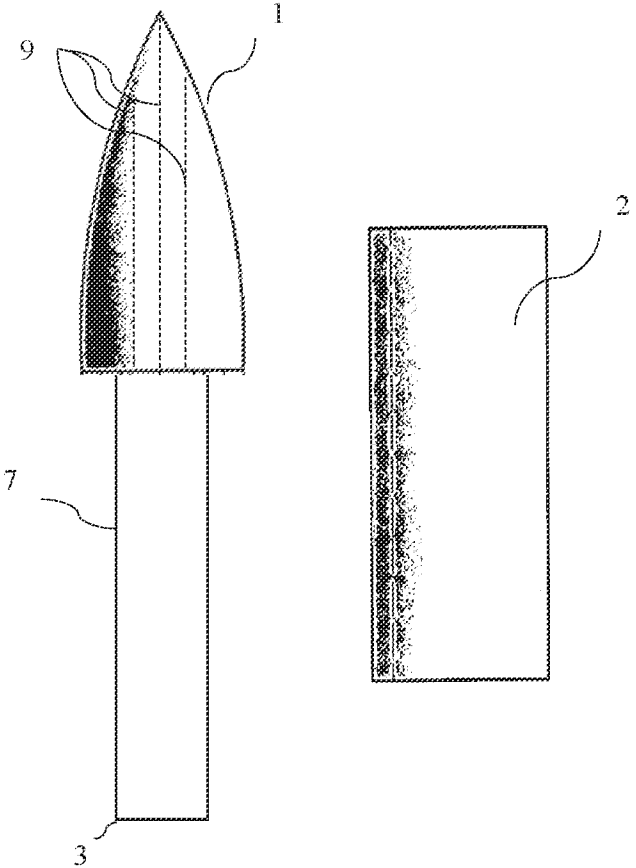
FIG. 5A is an exploded view of another embodiment of a projectile, according to one or more embodiments shown and described herein.

Referring now to FIGS. 5A and 5B, another embodiment of a projectile is depicted. As with the previous embodiments, the projectile may include a head component 1, a sleeve component 2, a base component 3, and a stem component 7. The head 1 of the projectile is shaped to provide aerodynamic properties suitable for flight. In these embodiments, the head 1 may further include a forward tip designed to minimize air resistance, and a rear end from which the stem component 7 extends. As has been described herein with reference to FIGS. 1-4, the head 1 may be optionally constructed with one or more separations 9 that allow for controlled expansion upon impact, enhancing the projectile's stopping power. In these embodiments, separations 9 may be defined as designed weak points in the head 1 that allow for controlled expansion upon impact. This expansion increases the diameter of the projectile as it enters a target, creating a larger wound channel and transferring more energy to the target, which may be advantageous in hunting or defensive scenarios.

Referring still to FIGS. 5A and 5B, extending rearward from the head 1 is the stem component 7, which may be formed integrally with the head 1. In these embodiments, the stem component 7 serves as a structural backbone for the projectile, and allows for the sleeve component 2 to be positioned and secured. Accordingly, it should be appreciated that the stem component 7 may have a rigidity capable of maintaining the structural integrity of the projectile during flight and upon impact. Furthermore, as depicted most clearly in FIG. 5B, the stem component 7 may be of a length that surpasses that of the sleeve component 2, ensuring proper engagement and rotational functionality. In other embodiments, it may be that the stem component 7 is formed separately and connected to the head 1, for example by thread, fastening, weld, or other connection methods and/or structure.

In the embodiments described herein, the sleeve component 2 may be a hollow, substantially cylindrical component that is coaxially aligned with the head 1 and stem component 7 of the projectile. The sleeve component 2 may be placed over the stem component 7 and is held in place between the head 1 and the base component 3, as will be described in additional detail herein with reference to FIGS. 6A and 6B. Upon discharge from a weapon, the rifling of the firearm barrel imparts rotation to the sleeve component 2, which is designed to rotate independently of the head 1 and the base component 3, thereby stabilizing the projectile's flight.

It should be further appreciated that, in some embodiments, the sleeve component 2 may be sized such that a tolerance exists between the sleeve component 2 and a main projectile section of the rifling of a weapon to allow for minor slippage between the projectile and the rifling. In these embodiments, the term "slippage" may refer to the movement (e.g., slip) of the projectile within the main projectile section of the weapon before the sleeve component 2 fully engages the rifling grooves. For example, as the projectile travels down the main projectile section, the sleeve component 2 may begin to rotate before fully engaging the rifling, which may allow for slight rotation of the sleeve component 2. In these embodiments, the slippage of the projectile may allow the projectile to gradually build up to its full rotational speed as the projectile traverses the main projectile section of the weapon. It should be appreciated that this gradual build up may aid in ensuring the projectile maintains a consistent spin rate during discharge. Furthermore, the consistent spin rate afforded by the slippage of the projectile may also improve the accuracy and stability of the projectile while reducing wear and tear on the weapon caused by discharge.

Referring still to FIGS. 5A and 5B, the sleeve component 2 may include an outer diameter that is the same or larger than an outer diameter of the head 1 and/or stem component 7. Accordingly, when the projectile is loaded in a weapon, an exterior surface of the sleeve component 2 may contact rifling of the weapon, while the head 1 and the base component 3 of the projectile do not contact the rifling. In these embodiments, the exterior surface of the sleeve component 2 include at least one engagement feature that may be configured to engage the rifling of the weapon, which may aid in the rotation of the sleeve component 2 during firing.

It should be further appreciated that, in some embodiments, the sleeve component 2 may, according to some embodiments, comprise a tapered section 8, which may abut the head 1 of the projectile when the sleeve component 2 is coupled to the head 1. For example, as depicted in FIG. 5B, the outer diameter of the sleeve component 2 may be larger than the outer diameter of the head 1. To improve aerodynamics between the sleeve component 2 and the head 1, the tapered section 8 of the sleeve component 2 may be tapered such that the portion of the tapered section 8 that contacts the head 1 has an outer diameter that is generally equal to the outer diameter of the head 1.

To further aid in rotation of the sleeve component 2, the sleeve component 2 may be formed of a sleeve material and the stem component 7 may be formed of a stem material that is different from the sleeve material. In these embodiments, the sleeve material may have a lower coefficient of friction than the stem material to facilitate independent rotation of the sleeve component 2 relative the stem component 7, the head 1, and the base component 3. Although the sleeve component 2 and the stem component 7 are described as being made of different materials, in other embodiments, it should be appreciated that each of the stem material and the sleeve material may be the same material without departing from the scope of the present disclosure.

Referring still to FIGS. 5A and 5B, the base component 3 of the projectile is formed integrally with the stem component 7 by pressing and expanding the rearward end of the stem component 7. The expansion of the stem 7 creates a flared section that captures the sleeve component 2 between the base and the head 1. Once flared, the outer diameter of the base component 3 may be larger than the inner diameter of the sleeve component 2, allowing the sleeve component 2 to rotate freely. In these embodiments, the base component 3 may further act to provide a counterbalance to the head 1, and may serve as the contact point connecting with a cartridge. Alternatively, in some embodiments, the sleeve component 2 may also define the contact point with the cartridge.

Figure 6A:
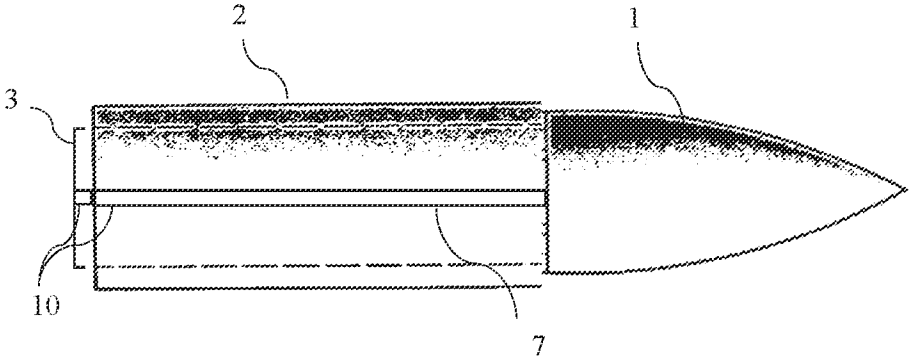
FIG. 6A is an assembled view of the projectile of FIGS. 5A and 5B with an unexpanded base, according to one or more embodiments shown and described herein.
Figure 6B:
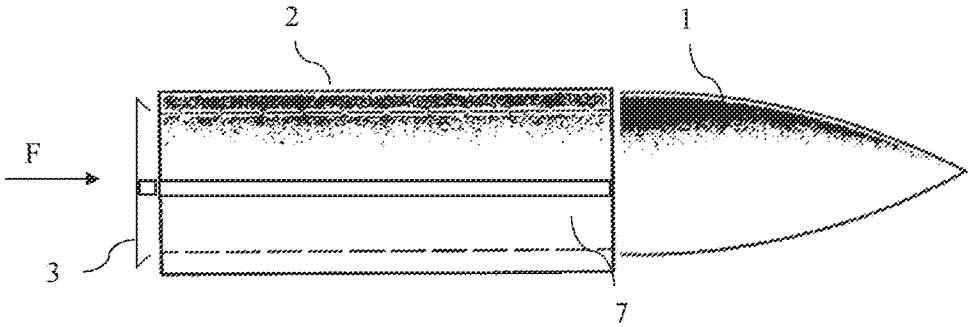
FIG. 6B is an assembled view of the projectile of FIG. 6A with an expanded base, according to one or more embodiments shown and described herein.

Turning now to FIGS. 6A and 6B, the expansion of the stem component 7 to form the base component 3 will be described in additional detail. For example, FIG. 6A depicts the rearward end of the stem component 7 in an unexpanded state. By utilizing an expansion process, such as "flaring" or "belling," the stem component 7 may be expanded to form the base component 3, as illustrated in FIG. 6B. In these embodiments, it should be appreciated that the flaring process may increase the outer diameter of the end portion of the stem component 7 such that the base component 3 has an outer diameter than is larger than an inner diameter of the sleeve component 2, such that the sleeve component 2 is captured on the stem component 7 between the base component 3 and the head 1.

In these embodiments, the stem component 7 may initially be a continuation of the head 1 of the projectile (e.g., formed integrally with the head 1) and may be formed from a ductile material that can be shaped under force without breaking. The sleeve component 2 may be placed over the stem component 7 in the correct position, typically after the head 1 and stem component 7 have been formed but before the base component 3 is flared. In these embodiments the sleeve component 2 and/or the stem component 7 may be further formed with an alignment mechanism 10 (e.g., alignment markings, grooves, notches, etc.) that may aid in aligning the sleeve component 2 and the stem component 7 before the base component 3 is formed.

Referring still to FIGS. 6A and 6B, once the sleeve component 2 is positioned on the stem component 7, an expansion mechanism, such as a flaring tool, may apply a force F to the rear end of the stem component 7. As the force F is applied (e.g., in an axial direction as depicted in FIG. 6B), the rear end of the stem component 7 may deform outward and expands. This expansion is controlled by the design of the expansion mechanism and the amount of force F applied to the stem component 7. In these embodiments, it may be desirable to expand the rear end of the stem component 7 just enough to create a flared base that is wider than the stem component 7 and the inner diameter of the sleeve component 2.

Referring still to FIGS. 6A and 6B, as the stem component 7 expands, the stem component 7 may capture the sleeve component 2 between the newly formed base component 3 and the head 1. Accordingly, the base component 3 may act as a mechanical lock that secures the sleeve component in place. Any additional shaping or finishing required for the base component 3 may then be completed, such as creating a smooth transition from the flared base component 3 to the stem component 7 or ensuring the base component 3 is flat and perpendicular to the stem component 7 for proper seating in a cartridge.

Figure 6D:
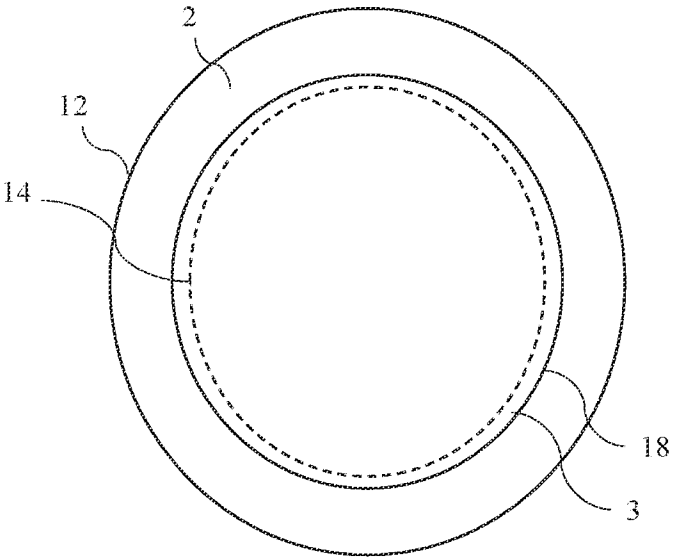
FIG. 6D is a side-view of the projectile of FIG. 6B with an expanded base, according to one or more embodiments shown and described herein.
Figure 6C:
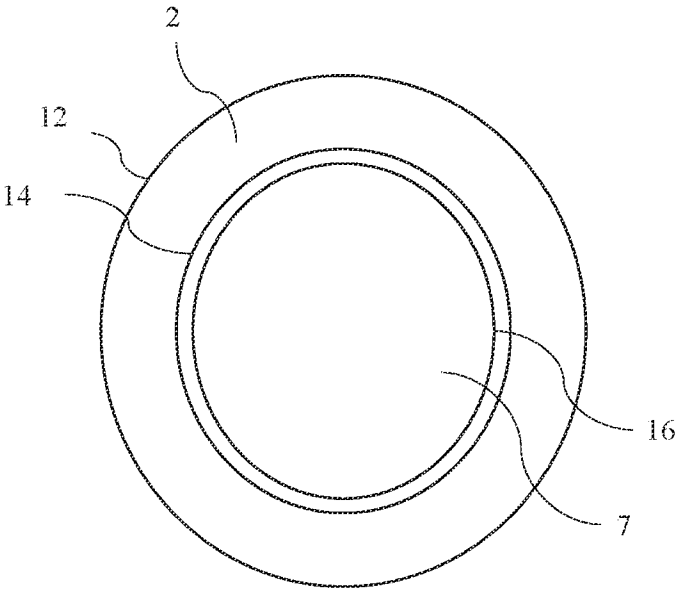
FIG. 6C is a side-view of the projectile of FIG. 6A with an unexpanded base, according to one or more embodiments shown and described herein.

Turning now to FIGS. 6C and 6D, the expansion of the stem component 7 is described in additional detail with reference to the diameters of the stem component 7, the sleeve component 2, and the base component 3. For example, in the unexpanded position, as depicted in FIG. 6C, the sleeve component 2 includes an outer diameter 12 and an inner diameter 14, with the inner diameter 14 of the sleeve component 2 being larger than an outer diameter 16 of the stem component 7, such that the sleeve component 2 may be positioned about the stem component 7, as has been described in detail herein.

With the sleeve component 2 positioned about the stem component 7, a force F (e.g., as depicted in FIG. 6B) may be applied to the stem component 7 to form the base component 3, as shown in FIG. 6D. In these embodiments, the force applied to the stem component 7 may cause the stem component 7 to expand radially outward, such that the outer diameter 16 of the stem component 7 increases. The force F may be continually applied to the stem component 7 until the base component 3 having an outer diameter 18 which is larger than an inner diameter 14 of the sleeve component 2 is formed at the end of the stem component 7. By forming the base component 3 with an outer diameter 18 that is larger than the inner diameter 14 of the sleeve component 2, the sleeve component 2 may be captured between the base component 3 and the head 1 of the projectile while still being capable of rotating independently relative the base component 3 and the head 1.

It should be noted that, in the embodiments described herein, additional machinery and/or equipment may be utilized to ensure that the integrity of the head 1 of the projectile is not compromised during the flaring process. For example, in some embodiments, the projectile may be placed in a mold and/or clamp made of rubber, plastic, or any other non-marring material to secure the head 1 of the projectile prior to applying the force F to the stem component 7. In these embodiments, the mold and/or clamp may further include a cavity shaped to fit the head 1 of the projectile without applying stress to the head 1 of the projectile during flaring. Accordingly, during the flaring process, the force F is only applied to the stem component 7, while the head 1 of the projectile remains cradled within the mold and/or clamp.

Furthermore, in other embodiments still, alternative solutions may be utilized to protect the head 1 of the projectile during the flaring process. For example, the base component 3 may be formed via automated precision flaring, during which a robotic flaring tool may apply a precision force to the stem component 7. In these embodiments, the robotic flaring tool may be programmed to ensure that the force F applied to the stem component is localized to the stem component 7 and does not impact the head 1. In other embodiments, vibrational damping materials may be utilized to support the head 1 during the flaring process. For example, in these embodiments, the vibration damping material may absorb energy generated during the flaring process, thereby preventing the force F from being transferred from the stem component 7 to the head 1. Similarly, advanced flaring processes may be utilized which minimize the mechanical stress exerted on the head 1 during flaring. For example, selective laser flaring and/or chemical flaring, which may utilize lasers or chemical processes to expand the stem component 7, respectively, may be capable of forming the flared base component 3 without affecting the head 1.

In the embodiments described herein, it should be appreciated that the expansion of the base 3 needs to be done with precision, as an inadequate flare may not secure the sleeve component 2 effectively, and an excessive flare could damage the sleeve component 2 or affect the bullet's aerodynamics. Accordingly, in some embodiments, the process of flaring the stem component 7 may also include steps of annealing (heat-treating) the stem component 7 to ensure the flared base component 3 has desirable properties for flaring without cracking or splitting.

Furthermore, it should be appreciated that the projectile including a flared base component 3 and method of forming a projectile described herein may be suitable for use in any caliber of projectile without departing from the scope of the present disclosure. For example, the projectile described herein may be a small caliber projectile (e.g., .22 long rifle, .25 Automatic Colt Pistol ("ACP"), .32 ACP, .380 ACP, etc.), a medium caliber projectile (e.g., 9 mm Luger, .38 Special, .40 Smith & Wesson, .45 ACP, etc.) a large caliber projectile (e.g., .44 Magnum, .50 Action Express, etc.), a rifle round (e.g., .223 Remington, .308 Winchester, .30-06 Springfield, .7 mm Remington Magnum, .300 Winchester Magnum, etc.) a Rimfire round (.17 Hornady Magnum Rimfire, .22 Magnum, etc.), a shotgun round (e.g., 12 gauge, 20 gauge, .410 gauge), a Magnum Rifle round (e.g., .338 Lapua Magnum, .416 Barrett, .50 Browning Machine Gun ("BMG"), etc.), a specialty and/or historical caliber (e.g., 45-70 Government, 8 mm Mauser, .3030 British, etc.), a precision shooting and/or long range projectile (e.g., 6.5 Creedmoor, .224 Valkyrie), a subsonic and/or suppressor optimized round (e.g., .300 Blackout, 9×39 mm, etc.), a military grade ammunition (e.g., .50 BMG, 20×102 mm), or any other similar projectile. As noted herein, it should be appreciated that the projectiles discussed herein are for illustrative purposes only, and the projectile may be any projectile for civilian and/or military use. In these embodiments, the design considerations of the projectile (e.g., the size of the stem component, the force required to form the flared base component, protective measures to maintain the head during flaring, etc.) may be determined based on the particular caliber of projectile utilized.

Referring now to FIGS. 6A-6D collectively, it should be appreciated that the flaring process may further impact how tightly the sleeve component 2 is pressed against the head 1 of the projectile once the base component 3 is formed. For example, a larger flare on the base component 3 may result in a tighter fit of the sleeve component 2 against the head 1. In these embodiments, the tight fit between the sleeve component 2 and the head 1 may ensure that the sleeve component 2 is held in place and is less likely to move independently from the head 1 and the stem component 7 during flight.

In contrast, a relatively smaller flare may result in a looser fit between the sleeve component 2 and the head 1. In these embodiments, the expansion of the rear of the stem component 7 is less pronounced, thereby allowing for a greater degree of movement of the sleeve component 2 relative the head 1 and the stem component 7.

Referring still to FIGS. 6A-6D, it should be appreciated that the size of the flare of the base component 3, and in turn, the fit between the sleeve component 2 and the head 1, may further impact the spin of the projectile. For example, in embodiments in which the sleeve component 2 is tightly fitted against the head 1, the sleeve component 2 may become more rigidly attached to the rest of the projectile (e.g., the head 1 and the base component 3). As a result, when the projectile is fired and the rifling of the weapon imparts spin to the sleeve component 2, the entire projectile (e.g., the head 1, sleeve component 2, and base component 3) is more likely to spin as a single unit. Accordingly, the projectile may have a higher spin stability, which may be beneficial in maintaining a straight trajectory and improving accuracy of the projectile. Although it is noted herein that the entire projectile may spin as a single unit during discharge from the weapon, it should be appreciated that the tight fit between the sleeve component 2 and the head 1 may still allow for the sleeve component 2 to rotate independently of the head 1 and the base component 3 when the projectile is not engaged with the weapon (e.g., such as when the projectile is being grasped by a user). However, the more rigid attachment between the sleeve component 2 and the head 1 may cause the sleeve component 2 to have more difficulty spinning independently, which may in turn increase a likelihood that the projectile spins as a single unit when discharged from the weapon.

In contrast, a relative looser fit between the sleeve component 2 and the head 1 may allow the sleeve component 2 to more easily rotate independently of the head 1 and the base component 3. In these embodiments, when the rifling of the weapon engages the sleeve component 2, the head 1 and the base component 3 may not spin, or may spin at different (e.g., lower) rates than the sleeve component 2. Accordingly, the differential spin between the sleeve component 2 and the rest of the projectile may create a gyroscopic effect, where the head 1 of the projectile maintains a desired orientation (e.g., trajectory) more consistently.

It should be further understood that the fit between the sleeve component 2 and the head 1 may have additional ballistic implications for the projectile. For example, a tighter fit (e.g., larger flare) may be more useful in conventional projectile where high degrees of trajectory and accuracy are desired. In contrast, specialized applications (e.g., projectiles configured for high degree of penetration) may benefit from a projectile in which a looser fit is maintained between the sleeve component 2 and the head 1. It should be appreciated that, in these embodiments, the fit between the sleeve component 2 and the head 1 may be determined based on the intended use of the projectile and its desired ballistic properties, and the fit between the sleeve component 2 and the head 1 may be adjusted by altering the size of the flare of the base component 3 (e.g., by adjusting the force applied to the stem component 7).

Figure 7:
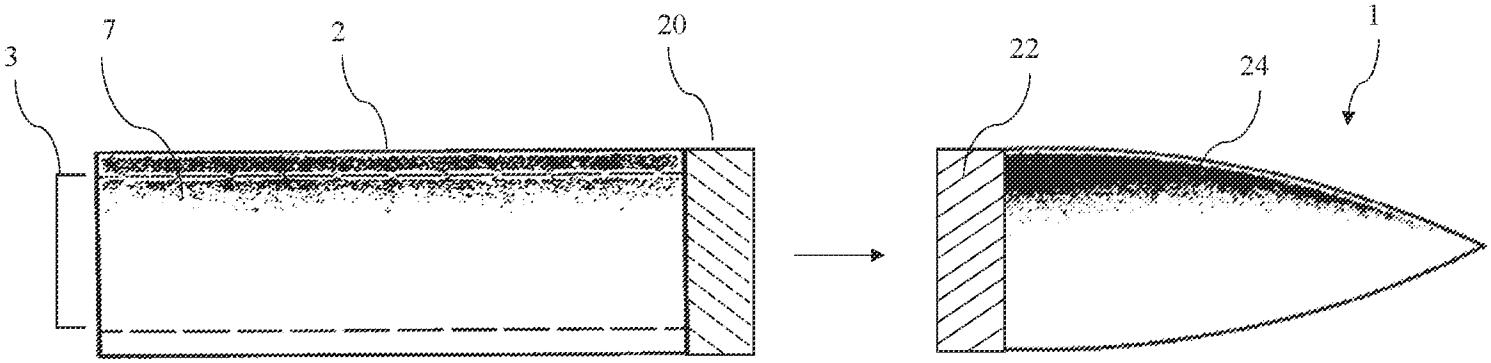
FIG. 7 is a side view of an embodiment of a projectile.

Turning now to FIG. 7, another embodiment of a projectile is depicted. In these embodiments, the head 1 may be a hollow structure including a head base 20 that may be threadably coupled to a threaded portion 22 of a head cap 24. As depicted in FIG. 7, the stem component 7 may extend from the head base 20, which may be form the primary structural component of the head 1 of the projectile and may be formed of a durable material capable of withstanding forces associated with discharging the projectile from a weapon. It should be appreciated that, in these embodiments, the head 1 may be formed of copper, brass, or any other similar material.

Referring still to FIG. 7, the head cap 24 may be a hollow section that may be configured to contain explosives, technological components, or other specialized materials. For example, in military and/or tactical applications, the head cap 24 may be filled with a volume of explosive material. Upon impact of the head cap 24 with a target, the explosive charge may discharge and cause additional damage beyond the kinetic impact of the head cap 24. In other embodiments, the head cap 24 may include a tracking device, a sensor, a camera, or any other similar device that may be used for reconnaissance, data collection, and/or precision targeting.

In the embodiments described herein, the head cap 24 may be filled with any of the components described herein (e.g., explosives, technological components, etc.) Once the head cap 24 is filled, the threaded portion 22 of the head cap may engage the head base 20 to couple the head cap 24 to the head base 20 and secure the explosive and/or technological materials within the head cap 24. In these embodiments, the head cap 24 may be secured to the stem component 7 either before or after the sleeve component 2 is secured to the stem component 7 and the base component 3 is formed. However, it should be appreciated that in certain applications (e.g., when explosive materials are housed within the head cap 24), it may be desirable to form the flared base component 3 and secure the sleeve component 2 to the stem component 7 prior to securing the head cap 24 to the head base 20 in order to minimize risks associated with unintentional detonation.

Referring still to FIG. 7, once the head cap 24 is filled with a desired material and secured to the head base 20, the projectile may behave like any of the projectiles described herein during flight. That is, the head cap 24 remains securely attached to the head base 20 due to the connection of the threaded portion 22 of the head cap 24 with the head base 20. Upon impact of the head cap 24 with a target, the design of the head cap 24 may dictate the behavior of the projectile. For example, in embodiments in which the head cap 24 contains explosives, the impact of the head cap 24 with the target may detonate the explosives. In other embodiments, such as those in which the head cap 24 contains technological components, the head cap 24 may separate from the head base under impact in order to deploy the payload housed within the head cap 24.

Figure 8:
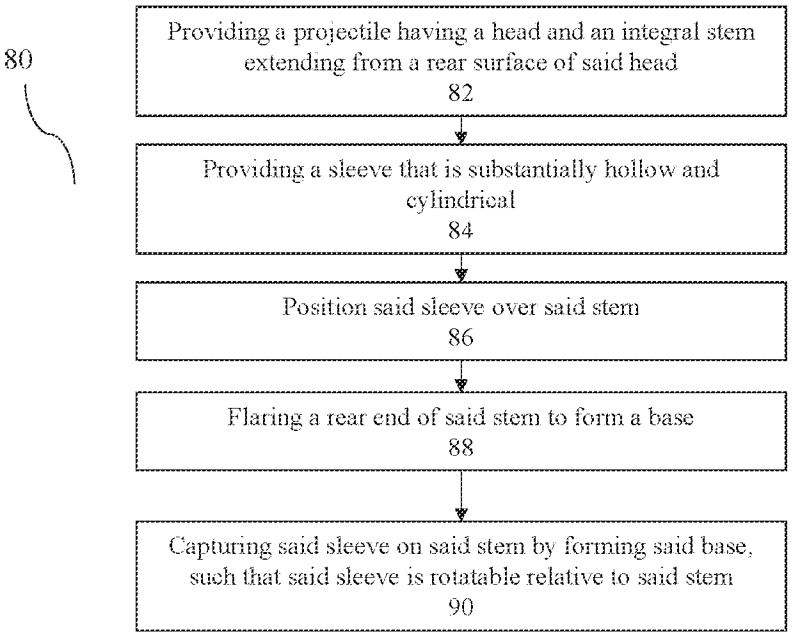
FIG. 8 is an illustrative flow diagram of a method for producing a two piece spinning projectile, according to one or more embodiments shown and described herein.

Referring now to FIG. 8, an illustrative diagram of a process 80 for producing a two piece spinning projectile is depicted. In these embodiments, the process 80 may involve providing a projectile having a head 1 and an integral stem component 7 extending from a rear surface of said head, as shown at block 82. With the projectile provided, the process may advance to block 84, which may involve providing a sleeve component that is substantially cylindrical and hollow. In these embodiments, the sleeve component may be positioned over the stem component, as illustrated at block 86.

With the sleeve component positioned over the stem component, the process may advance to block 88, which may involve flaring a read end of the stem component to form a base component. As the stem component is flared to form the base component, the process may further involve capturing the sleeve component on the stem component by forming the base component, such that the sleeve component is rotatable relative the stem component, as shown at block 90.

This detailed description and the accompanying drawing illustrate the some embodiments of the projectile, but it is to be understood that the invention is not limited to the precise details herein described. Variations that do not depart from the gist of the invention are intended to be included within the scope of the claims.

As noted above, the present innovation is believed to have the advantage of reducing the mass of the projectile that must spin. This is believed to reduce any disturbances in ballistics caused by wobbling due to inconsistencies within the projectile itself. Further, by reducing the surface area that contacts the inner bore surface, it is believed that there will be a reduction of projectile friction, and thus a reduction of heat generation that will lead to an increase in the sustained firing rate. The reduction of the friction between the projectile and the bore will also likely result in a reduction in the powder charge needed to fire the projectile. Reducing the powder charge may enhance the ability to provide for better silencing of subsonic rounds for pistols and rifles, putting more rounds on target. Reduced powder charges should also allow for more ammunition to be carried by the battlefield warrior.

In addition to the above benefits, for large-bore diameter projectiles, a spinning projectile design is believed to allow for an extended range for the projectile trajectory, with a concomitant increased range for standoff distance. These benefits should increase safety of the warrior in battlefield conditions.

An embodiment of the present invention is a projectile for discharging from a weapon with a bore having inner rifling. The projectile has a head, a base, and a sleeve. The head and base are disposed within the sleeve, and the sleeve has a diameter larger than the diameter of the head and base. The sleeve can rotate independent of the head and base and is the only portion of the projectile that engages with the inner rifling and is thus the only portion of the projectile that is subject to spinning imparted by the rifling.

Another embodiment of the present invention is a projectile for discharging from a weapon having inner rifling. The projectile has a generally cylindrical body, a generally pointed head attached to an end of the body, and a cylindrical sleeve having a diameter larger than said body and head. The body and head are disposed within the sleeve. The sleeve is rotatable independent of the head and body. The sleeve engages with the inner rifling and is subject to spinning imparted by the rifling.

Another embodiment is a method of firing a weapon. The method comprises aiming a weapon comprising a bore having inner rifling toward a target, and discharging a projectile, comprising a generally cylindrical body, a generally pointed head attached to an end of the body, and a cylindrical sleeve having a diameter larger than the body and head wherein the body and head are disposed within the sleeve.

This summary of the invention does not necessarily describe all features of the invention.

An embodiment of the invention is disclosed herein, and it should be understood that numerous modifications, alterations, and variations are possible and practicable by those skilled in the art while still coming within the spirit of the invention and scope of the invention as set forth in the appended claims. While the foregoing written description and drawings of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed. Moreover, the terms "consisting", "comprising" and other derivatives from the term "comprise" are intended to be open-ended terms that specify the presence of any stated features, elements, steps, or components, and are not intended to preclude the presence or addition of one or more other features, elements, integers, steps, components, or groups thereof. Moreover, Applicants have endeavored in the present specification and drawings to draw attention to certain features of the invention, it should be understood that the Applicant claims protection in respect to any patentable feature or combination of features referred to in the specification or drawings. The drawings are provided to illustrate features of the invention, but the claimed invention is expressly not limited to the illustrated embodiments.

Further aspects of the embodiments described herein are provided by the subject matter of the following clauses:

1. A projectile, comprising: a head having a forward tip and a rear end; a stem extending from said rear end of said head and formed integrally with said head; a sleeve, said sleeve positioned adjacent to said head and being collinear with said head, said sleeve being coaxial with said stem; said sleeve being hollow and substantially cylindrical and having an inner diameter and an outer diameter; and a base formed integrally with said stem by pressing a rearward end of said stem and expanding a rear dimension of said stem to capture said sleeve between said base and said head; wherein the head and the base are rotatably dependent upon each other by connection with said stem, and wherein said head, said stem, and said base are rotationally independent of said sleeve.

2. The projectile of clause 1, wherein said base has an outer diameter that is larger than said inner diameter of said sleeve, such that said sleeve is configured to rotate upon discharge of said projectile.

3. The projectile of clause 1, wherein said sleeve rotates independently of said head and said base, and said sleeve rotation imparted by discharge of said projectile.

4. The projectile of clause 1, said stem being longer than said sleeve.

5. The projectile of clause 1, wherein said head and said stem are joined together during manufacture.

6. The projectile of clause 1, wherein said base expands by application of force to retain said sleeve on said stem.

7. The projectile of clause 1, said base being defined by a flare of an end of said stem.

8. The projectile of clause 1, said head having a one or more separations which allow for expansion upon impact.

9. The projectile of clause 1, wherein said sleeve includes at least one engagement feature on an exterior surface of said sleeve, said at least one engagement feature being configured to interact with rifling of a weapon.

10. The projectile of clause 1, wherein said sleeve is formed of a sleeve material and said stem is formed of a stem material, said sleeve material having a lower coefficient of friction than said stem material to facilitate independent rotation of said sleeve.

11. The projectile of clause 1, wherein said base is configured to expand radially outward upon application of an axial force to capture said stem between said base and said head.

12. The projectile of clause 1, wherein said stem and said base each include an alignment mechanism for aligning said stem and said base.

13. The projectile of clause 1, wherein said forward tip of said head is a hollow tip and is formed of at least one of copper or brass.

14. The projectile of clause 1, wherein said forward tip of said head is a monolithic one-piece structure.

15. A projectile, comprising: a base; a stem passing through a hollow interior of said base; a head at an end of said stem opposite from said base; and a sleeve disposed over said stem and captured between said base and said head, said sleeve capable of rotation relative to said head, said stem, and said base; said head disposed at one axial end of said sleeve, and said base disposed at an opposite axial end of said sleeve; said base formed by a flared end of said stem; said sleeve having a larger diameter than said head and said base such that said sleeve is configured to rotate; wherein said sleeve rotates independently of said head and said base.

16. The projectile of clause 15, said stem being longer than said sleeve.

17. The projectile of clause 15, wherein said head and said stem are joined together during manufacture.

18. The projectile of clause 15, wherein said base expands by application of force to retain said sleeve on said stem.

19. The projectile of clause 15, said head having a one or more separations which allow for expansion upon impact.

20. A process for producing a two piece spinning projectile, comprising the steps of: providing a bullet having a head and an integral stem extending from a rear surface of said head; providing a sleeve that is substantially cylindrical and hollow; positioning said sleeve over said stem; flaring a rear end of said stem to form a base; and capturing said sleeve on said stem by forming said base, such that said sleeve is rotatable relative to said stem.

The terminology used herein is for the purpose of describing particular aspects only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. The term "or a combination thereof" means a combination including at least one of the foregoing elements.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A projectile, comprising:

a head having a forward tip and a rear end;

a stem extending from said rear end of said head and formed integrally with said head;

a sleeve, said sleeve positioned adjacent to said head and being collinear with said head, said sleeve being coaxial with said stem;

said sleeve being hollow and substantially cylindrical and having an inner diameter and an outer diameter; and a base formed integrally with said stem by pressing a rearward end of said stem and expanding a rear dimension of said stem to capture said sleeve between said base and said head;

wherein the head and the base are rotatably dependent upon each other by connection with said stem, and wherein said head, said stem, and said base are rotationally independent of said sleeve.

2. The projectile of claim 1, wherein said base has an outer diameter that is larger than said inner diameter of said sleeve, such that said sleeve is configured to rotate upon discharge of said projectile.

3. The projectile of claim 1, wherein said sleeve rotates independently of said head and said base, and said sleeve rotation imparted by discharge of said projectile.

4. The projectile of claim 1, said stem being longer than said sleeve.

5. The projectile of claim 1, wherein said head and said stem are joined together during manufacture.

6. The projectile of claim 1, wherein said base expands by application of force on said rearward end of said stem to form said base and retain said sleeve on said stem.

7. The projectile of claim 1, said base being defined by a flare of said rearward end of said stem.

8. The projectile of claim 1, said head having a one or more separations which allow for expansion upon impact.

9. The projectile of claim 1, wherein said sleeve includes at least one engagement feature on an exterior surface of said sleeve, said at least one engagement feature being configured to interact with rifling of a weapon.

10. The projectile of claim 1, wherein said sleeve is formed of a sleeve material and said stem is formed of a stem material, said sleeve material having a lower coefficient of friction than said stem material to facilitate independent rotation of said sleeve.

11. The projectile of claim 1, wherein said base is configured to expand radially outward upon application of an axial force to capture said stem between said base and said head.

12. The projectile of claim 1, wherein said stem and said base each include an alignment mechanism for aligning said stem and said base.

13. The projectile of claim 1, wherein said forward tip of said head is a hollow tip and is formed of at least one of copper or brass.

14. The projectile of claim 1, wherein said forward tip of said head is a monolithic one-piece structure.

15. A projectile, comprising:

a base;

a stem adjacent to said base;

a head at an end of said stem opposite from said base; and a sleeve disposed over said stem and captured between said base and said head, said sleeve capable of rotation relative to said head, said stem, and said base;

said head disposed at one axial end of said sleeve, and said base disposed at an opposite axial end of said sleeve;

said base formed by a flared end of said stem;

said head, said stem, and said base being integrally formed;

said sleeve having a larger diameter than said head and said base such that said sleeve is configured to rotate due to engagement of rifling of a weapon upon discharge of said weapon;

wherein said sleeve rotates independently of said head and said base.

16. The projectile of claim 15, said stem being longer than said sleeve.

17. The projectile of claim 15, wherein said head and said stem are joined together during manufacture.

18. The projectile of claim 15, wherein said base expands by application of force to retain said sleeve on said stem.

19. The projectile of claim 15, said head having a one or more separations which allow for expansion upon impact.

* * * * *